United States Patent [19]

Nakata

[11] Patent Number: 4,545,155

[45] Date of Patent: Oct. 8, 1985

[54] METHOD FOR REMOVING FLASHES FROM MOLDED RESIN PRODUCT

[75] Inventor: Junji Nakata, Yokohama, Japan

[73] Assignee: Tokyo Shibaura Denki Kabushiki Kaisha, Japan

[21] Appl. No.: 522,735

[22] Filed: Aug. 12, 1983

[30] Foreign Application Priority Data

Aug. 20, 1982 [JP] Japan ..... 57-143313

[51] Int. Cl.[4] ..... B24B 1/00

[52] U.S. Cl. ..... 51/320; 51/321

[58] Field of Search ..... 51/320, 321

[56] References Cited

U.S. PATENT DOCUMENTS 2,426,072 8/1947 Wall et al. ..... 51/320

2,774,679 12/1956 Remer ..... 51/321

3,090,166 5/1963 Straub ..... 51/320

3,142,590 7/1964 Hergonson ..... 51/320

3,313,067 4/1967 Smith et al. ..... 51/320

3,396,495 8/1968 Voss ..... 51/320

FOREIGN PATENT DOCUMENTS 50-39874 12/1975 Japan .

*Primary Examiner*—James Derrington

*Attorney, Agent, or Firm*—Cushman, Darby & Cushman

[57] ABSTRACT

A method for removing resin flashes formed during molding of a workpiece by wet blasting, wherein the wet blasting is carried out by blasting onto the workpiece a slurry comprising a synthetic resin abrasive, water and a surfactant.

9 Claims, 3 Drawing Figures non-ionic, or ampholytic type. For example, derivatives of imidazoline and carboxylic acid may be employed. However, when removing flashes from a plastic encapsulated semiconductor package, it is preferable to use a non-ionic surfactant which does not contain metal ions, halogens, ammonia, phosphorus, sulfur or the like, which may adversely affect the semiconductor element. Examples of such a non-ionic surfactant include polyoxyethylene alkyl ether, polyoxyethylene alkyl ester, polyoxyethylene alkyl phenol ether, sorbitan alkyl ester, polyoxyethylene glycol ether, and polyoxyethylene sorbitan alkyl ester. The amount of such a surfactant to be contained in the synthetic resin abrasive of the present invention is not determined by the type of surfactant used or application of the abrasive. However, a surfactant can be added, in general, in the amount of 0.0001 to 1% by weight. When a surfactant is mixed in the particles of a synthetic resin abrasive, it is mixed to such a degree that the surfactant slightly spreads out from the surface of the particles.

According to the present invention, a slurry consisting of water, a synthetic resin abrasive and a surfactant, and having a low surface tension is used for removing resin flashes from resin molded products. Accordingly, the synthetic resin abrasive is homogeneously dispersed in the slurry and is uniformly blasted onto the workpiece. Water can easily enter gaps between the resin flashes and the workpiece through cracks which are formed upon collision of the abrasive against the workpiece. With the aid of vibration caused upon collision of the abrasive particles against the resin flashes, removal of the flashes is facilitated, resulting in high performance. Since use of a surfactant can prevent electric charging of the workpiece being treated, generation of static electricity upon spraying of the slurry onto the workpiece is prevented. Neither the abrasive particles nor pieces of the flashes become attached to the workpiece, thereby facilitating a subsequent cleaning step. Thus, if a workpiece is a molded product such as a plastic encapsulated semiconductor package, neither defects in outer appearance caused in a subsequent soldering or plating step nor corrosion will occur. Since the surfactant does not contain a component which may adversely affect the operation of a semiconductor device, such as chlorine or sulfur, reliability of the semiconductor device is not impaired.

DETAILED DESCRIPTION OF THE PREFERRED EMBODIMENTS

The present invention will now be described through examples.

EXAMPLE 1

A catalyst 55% "MEKPO" (methyl ethyl ketone peroxide) was added in the amount of 2% to an unsaturated polyester ester "R235A-1" (tradename of Mitsui Toatsu Chemicals, Inc.) The resultant mixture was injected into a mold having dimensions of 300×300×20 (mm). After the resultant unsaturated polyester resin block were granulated by a crusher, a hammer or the like, the granules were then milled by a ball mill, a roll mill, a jet mill or an impact grinder to provide unsaturated polyester resin particles having an average size of about 0.7 mm and a number of blade-like edges.

An abrasive consisting of these unsaturated polyester resin particles was suspended in water in the amount of 5 to 30% by weight (about 20% by weight for optimal effects). Polyoxyethylene nonyl ether (a non-ionic surfactant) was then added in the amount of 0.0001 to 1% by weight to the suspension to provide a slurry.

Figure 2:
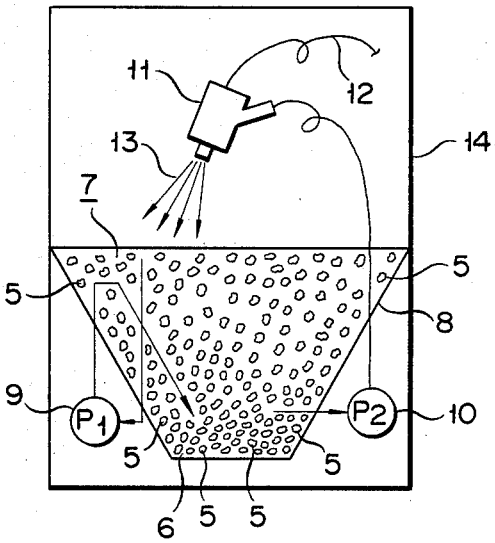
FIG. 2 is a representation of a wet-type blasting apparatus for practicing the method of the present invention.
Figure 3:
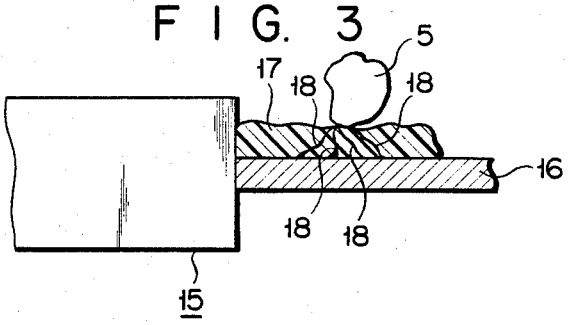
FIG. 3 is a partial sectional view for explaining flash removal using a synthetic resin abrasive according to the method of the present invention.

A slurry 7 prepared in this manner was deposited in a hopper 8 of a wet-type blasting apparatus shown in FIG. 2. Subsequently, the slurry 7 was drawn by suction by a first pump 9 and was drawn toward the bottom of the hopper 8. Then, the slurry 7 was uniformly agitated until a synthetic resin abrasive 5 was uniformly dispersed. The slurry 7 was then drawn by suction by a second pump 10 from the bottom of the hopper 8 and was supplied to a gun 11. The gun 11 served to accelerate the slurry 7 and blasted a three-phase high-speed jet flow 13 of water, abrasive and air onto a plastic encapsulated semiconductor package (not shown) placed a treatment chamber 14.

When the synthetic resin abrasive 5 collides against a resin flash 17 formed on a lead frame 16 of a semiconductor device 15, the resin flash 17 consisting of a brittle cured thermosetting resin forms cracks 18. Water rendered by the surfactant to have a low surface tension for a higher osmotic pressure easily enters into the gap between the resin flash 17 and the cracks 18. Thus, the resin flash 17 is floated away from the lead frame 16 to facilitate separation. Together with the vibration caused upon collision of the synthetic resin abrasive 5 against the resin flash 17, a gap is formed between the lead frame 16 and the resin flash 17. As particles of the synthetic resin abrasive 5 repeatedly collide against the cracks 18, the resin flash 17 is completely removed.

Flash removal was performed for 100 samples each using Example 1 in which a surfactant was contained in the slurry 7 and using a Control to which no surfactant was added. The flash removal was performed under identical conditions including spray pressure, slurry flow rate, and spray time, in each case. The flash removal performance was evaluated on the basis of the number of samples of the original 100 from which all flashes were completely removed. In the case of the Control, resin flashes remained in 20 to 30 samples, while the flashes were completely removed from all of the 100 samples using Example 1. Furthermore, Example 1 resulted in a spray time 20% faster than that of the Control. Accordingly, using Example 1, the flashes can be completely removed even if the spray pressure is not particularly high. Thus, deformation of the lead frame due to the jet flow can be prevented.

In Example 1, generation of static electricity was prevented, and neither the removed flashes nor the abrasive particles became attached to the semiconductor device 15 or to a jig for conveying it. In synergism with the self-cleaning effect of the surfactant, a subsequent cleaning step was thereby facilitated.

EXAMPLE 2

Polyoxyethylene nonyl ether (a non-ionic surfactant) was added to an unsaturated polyester resin solution, and the mixture was agitated to provide a homogeneous

METHOD FOR REMOVING FLASHES FROM MOLDED RESIN PRODUCT

BACKGROUND OF THE INVENTION

I. Field of the Invention

The present invention relates to a method for removing flashes formed in a molded resin product such as a plastic encapsulated semiconductor package.

II. Description of the Prior Art

Figure 1:
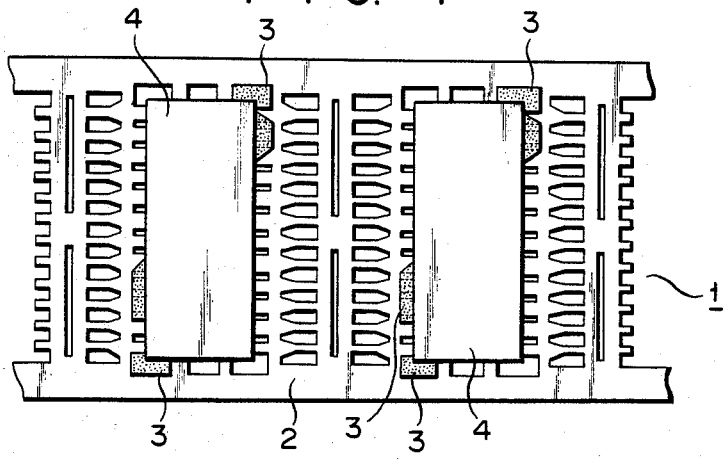
FIG. 1 is a plan view showing a plastic encapsulated semiconductor package showing the appearance of resin flashes.

In a plastic encapsulated semiconductor package 1 shown in FIG. 1, a semiconductor element (not shown) such as an IC or an LSI is placed on a lead frame 2. After wiring is formed, the structure is placed in a mold, and an epoxy resin is injected into the mold for encapsulation. However, during molding, the epoxy resin leaks through the gap between the lead frame 2 and the mold to form flashes 3 on the lead frame 2 and in the gaps between the leads of the lead frame 2. When a columnar electric element such as a diode is to be plastic-encapsulated, the epoxy resin leaks out through the gap between a pair of upper and lower molds, thereby forming flashes around the columnar molded product. Plastic encapsulation of such a columnar electric element therefore requires a post-molding step to remove such flashes. In view of this problem, a hard abrasive such as alumina, silicon carbide or glass bead, or a soft abrasive such as a walnut shell powder is blasted onto the flashes 3 to remove them.

However, a problem is encountered when a hard abrasive is used. That is, an abrasive with a hardness $H_RC$ of 70 or more while the epoxy resin useful for a semiconductor device has a hardness $H_RM$ of about 100. Thus, the abrasive is far harder than the epoxy resin, and has a specific gravity four times that of the epoxy resin. For this reason, when the flashes 3 are removed, the surface of the package 1 is damaged, to have a poor outer appearance. In addition to this, moisture may be introduced through the damaged portions of the package 1, adversely affecting reliability of the semiconductor element. On the other hand, a problem is also encountered when a soft abrasive such as a walnut shell powder is used. Since such a soft abrasive has an removal ability which is weaker than that of a hard abrasive, a soft abrasive must be blasted at a higher pressure than a hard abrasive. This leads to deformation of the lead frame 2 and a higher running cost of the equipment for manufacturing the molded products, since a larger amount of compressed air is used. Furthermore, when a soft abrasive is used, static electricity is generated between the abrasive and the molded product 1 upon contact therebetween. The static electricity firmly attaches the fine powder of the abrasive, flashes and the like to the surface of the package 1. As a result, an outer appearance of the package 1 is degraded in a subsequent soldering or plating step. This also leads to a problem of corrosion of the lead frame 2.

SUMMARY OF THE INVENTION

To prevent these problems the present invention has as its object a method for removing flashes from a workpiece or molded resin product with greater efficiency which will not damage the molded resin product, which significantly reduces attachment of the small pieces of the abrasive to the molded product, and which allows an easy post-treatment after flash removal.

In order to achieve the above object, there is provided according to the present invention a method for removing flashes from a molded resin product by wet-blasting, wherein a slurry comprising a synthetic resin abrasive, water and a surfactant is blasted onto the molded resin product.

According to the present invention, a synthetic resin having a relatively high hardness and a small ductility is preferred. Examples of such a synthetic resin may include thermosetting resins such as an epoxy resin, a urea resin, an unsaturated polyester resin, an alkyd resin, or a melamine resin; or relatively hard thermoplastic resins such as polystyrene, polycarbonate or an acrylic resin. In particular, since a thermosetting resin can provide particles which have a polygonal shape and sharp edges, it is preferred for flash removal.

When flashes are to be removed from a plastic encapsulated semiconductor package, an unsaturated polyester resin or an alkyd resin having a hardness equal or close to that of the resin for encapsulation (e.g., hardness $H_RM$ of 80 to 120) is optimal when the product is encapsulated with an epoxy resin having a hardness $H_RM$ of about 100. The size of the synthetic resin particles can be freely selected in accordance with the application of the abrasive. However, when an abrasive is to be used for removing flashes from a molded product, the abrasive should, preferably, consist of particles having an average size (defined as $\frac{1}{2}$ the sum of the maximum diameter and the minimum diameter) of 0.05 to 2.0 mm (i.e., more than 50% of all the particles preferably have sizes distributed in the range of 0.05 to 2.0 mm).

The shape of the particles of the resin may be arbitrarily selected and may be spherical, needle-like, flat, polygonal and so on. Also, a mixture of particles having different shapes may be used. An abrasive consisting of particles having different shapes generally has a better performance than an abrasive consisting of particles of a single shape.

The particles of the resin abrasive preferably have a large number of cutting edges to grind a workpiece or remove flashes therefrom upon being blasted against the workpiece by a compressor.

Thus, the average size and shape of particles of an abrasive can be determined depending upon various features of a workpiece to be worked upon, the precision required for this specific workpiece, and so on.

The synthetic resin abrasive particles as described above are obtained by the following procedures. A synthetic resin mass is formed into a thin sheet or the like. The sheet is crushed by a crusher or a hammer to obtain resin granules. The resin granules are milled by a roll mill, a ball mill, a jet mill, a cutter or an impact grinder. The particles obtained are passed through a mesh to have the required predetermined size distribution.

The slurry consisting of a synthetic resin abrasive, water and a surfactant to be used with the present invention can be produced by adding a suitable amount, for example, 0.0001 to 1% by weight of the surfactant with respect to the total amount of the slurry, and either mixing it with the abrasive or coating it thereon so that the surfactant gradually smears out into the slurry during abrasion. When cracks are formed in resin flashes by collision of synthetic resin particles, the surfactant allows easy entrance of water into gaps between the flashes and the lead frame. The surfactant also serves to prevent electric charging of the workpiece to be treated upon collision with the synthetic resin particles. The surfactant to be used herein may be of cationic, anionic, mixture. A catalyst 55% "MEKPO" as used in Example 1 was added in the amount of 2% to the mixture and the resultant mixture was injected into a mold having the dimensions of 300×300×20 (mm) for curing.

A cured resin block was granulated by a crusher, a hammer or the like. The granules were then milled by a ball mill, a roll mill or an impact grinder. The obtained particles were classified to provide synthetic resin particles having a hardness $H_RM$ of 100 and an average size of 0.7 mm. The synthetic resin particles contained 0.01 to 0.1% by weight of the surfactant and had a polygonal shape.

The particles were suspended in water (three parts water to one part particles based on weight). A resultant slurry was used for flash removal from plastic encapsulated semiconductor packages in a similar manner to that used in Example 1. Similar results to those in Example 1 were obtained.

EXAMPLE 3

After submerging a synthetic resin abrasive obtained in Example 1 in a 1% by weight of aqueous solution of sorbitan alkyl ester several times, or after spraying the abrasive with the aqueous solution of sorbitan alkyl ester, it was dried and was then coated with a surfactant. The abrasive was then suspended in water (five parts water to one part abrasive based on weight) to provide a slurry. The slurry was used for flash removal from plastic encapsulated semiconductor packages using the same blasting apparatus as that used in Example 1. Similar effects to those obtained in Example 1 were obtained.

Although polygonal particles consisting of a cured thermosetting resin are used for a synthetic resin abrasive of the present invention, the present invention is not limited to this application. It was confirmed that similar results to those obtained in Examples 1 to 3 can be obtained if a synthetic resin abrasive consisting of a thermoplastic resin such as a polyamide resin, a polycarbonate resin or a polystyrene resin is used.

What is claimed is:

1. A method for removing resin flashes formed during molding of a workpiece by wet blasting, wherein a slurry comprising a synthetic resin abrasive, water and a non-ionic surfactant containing no trace of metal ions, halogens, ammonia, phosphorus and sulfur is blasted onto the workpiece.

2. A method according to claim 1, wherein the surfactant is contained in the slurry in an amount of 0.0001 to 1% by weight.

3. A method according to claim 1, wherein the synthetic resin abrasive comprises particles having cutting edges.

4. A method according to claim 3, wherein the particles are of a thermosetting resin.

5. A method according to claim 4, wherein the thermosetting resin is selected from the group consisting of epoxy resin, urea resin, unsaturated polyester resin, alkyd resin and melamine resin.

6. A method according to claim 3, wherein the particles are of needle-like, flat or polygonal shape.

7. A method according to claim 3, wherein the particles have an average size of 0.05 to 2.0 mm.

8. A method according to claim 1, wherein the synthetic resin abrasive has the non-ionic surfactant at least on the surface thereof.

9. A method for removing resin flashes formed during molding of a workpiece comprising the steps of forming cracks in the flashes by blasting a slurry comprising a synthetic resin abrasive, water and a non-ionic surfactant onto the workpiece and allowing the water to enter the cracks due to said surfactant whereby removal of said flashes is facilitated.

* * * * *